United States Patent [19]

Irmen

[11] Patent Number: 4,566,260

[45] Date of Patent: Jan. 28, 1986

[54] PNEUMATIC YARN SPLICING DEVICE

[75] Inventor: Wolfgang Irmen, Monchen-Gladbach, Fed. Rep. of Germany

[73] Assignee: W. Schlafhorst & Co., Monchen-Gladbach, Fed. Rep. of Germany

[21] Appl. No.: 634,563

[22] Filed: Jul. 26, 1984

[30] Foreign Application Priority Data

Jul. 27, 1983 [DE] Fed. Rep. of Germany ..... 3326966

[51] Int. Cl.[4] ..... D01H 15/00

[52] U.S. Cl. ..... 57/22

[58] Field of Search ..... 57/22, 261, 263

[56] References Cited

U.S. PATENT DOCUMENTS

| | | | |
|---|---|---|---|
| 4,408,442 | 10/1983 | Rohner | 57/261 X |
| 4,433,534 | 2/1984 | Mima | 57/261 X |
| 4,494,368 | 1/1985 | Mima | 57/22 |
| 4,499,715 | 2/1985 | Chardon et al. | 57/22 |

*Primary Examiner*—Donald Watkins

*Attorney, Agent, or Firm*—Herbert L. Lerner; Laurence A. Greenberg

[57] ABSTRACT

The splicer head (5) of a pneumatic yarn splicer device (1) is provided on either side with pneumatic holding devices (15, 16) for holding the respective yarn ends (34', 35') of the yarns to be spliced together (34, 35), the inlet-mouths (33) of these holding devices having inserting aids for the yarn ends (34', 35') shaped as recesses (36, 37) of varying depth and of limited extent. With the help of said inserting aids, the yarn ends can be seized more rapidly, held more securely, and, as required, be prepared for splicing better and more rapidly.

5 Claims, 5 Drawing Figures

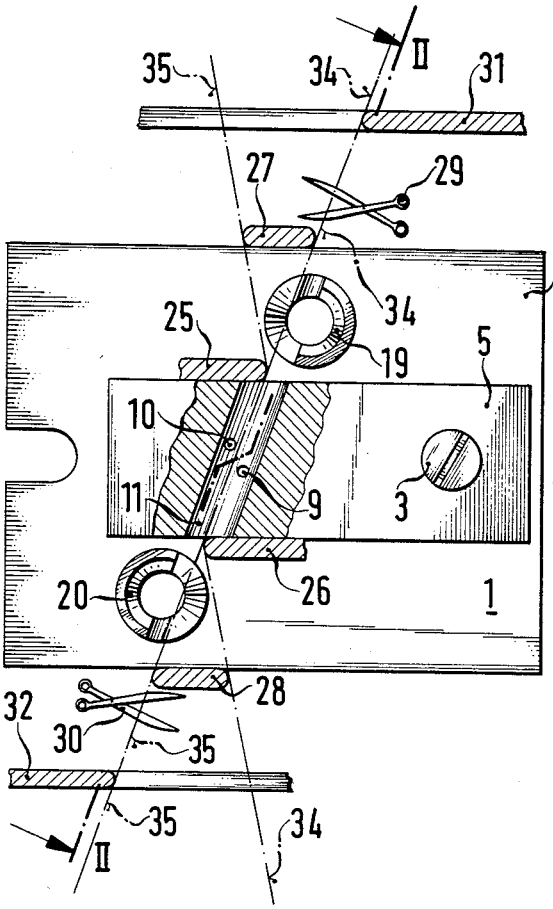
FIG. 1
FIG. 2
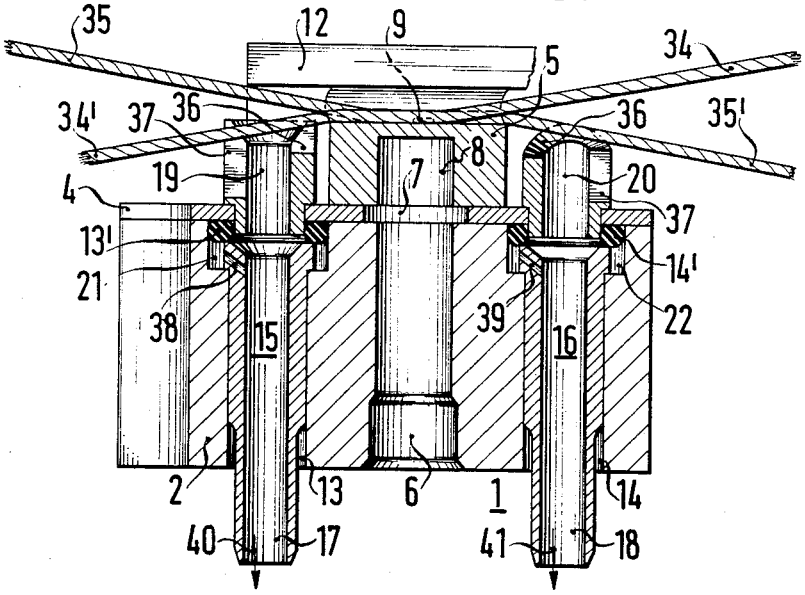

FIG. 4
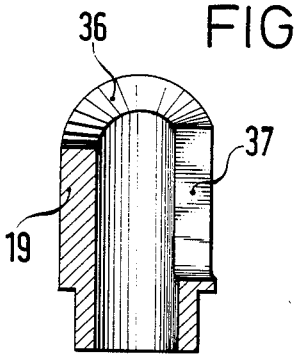
FIG. 5
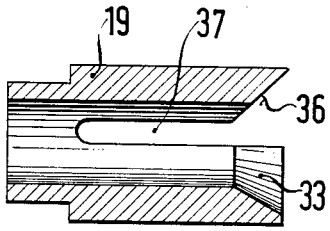
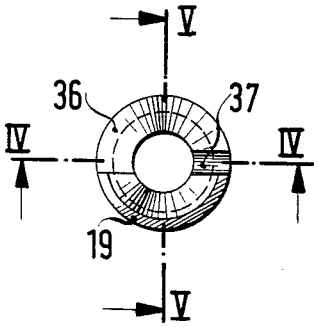
FIG. 3

PNEUMATIC YARN SPLICING DEVICE

The invention relates to a pneumatic yarn slicing device for the production of a knotfree yarn joint by means of splicing, including a splicer head having at least one inlet formed therein for the injection of compressed air, the splicer head receiving the yarn ends to be spliced together and allowing the entanglement, interlocking, intermingling and/or intertwining of their fibres with one another, pneumatic holding devices arranged on either side of the splicing head, each respective pneumatic holding device having a tubular inlet for holding the respective yarn ends of the yarn to be spliced together during the yarn preparing process.

IN such pneumatic yarn splicing devices it it a problem, during the short interval of time available for the preparation of the yarn ends, to pneumatically seize, hold fast and, as required, prepare for splicing the yarn end produced by severing a yarn. Therefore, unsuccessful splicings occur due to failure of the yarn being held property.

The object of this invention is to ensure strong and durable spliced yarn joints and, especially, to reduce the numbert of unsuccessful splicings.

This object is achieved according to the invention by the mouths of the inlets of the pneumatic holding devices having inserting aids for the yarn ends, shaped as recesses and/or elevations of varying depth and/or limited extent. The pneumatic holding devices operate with intermittent, air-whirlscreating air streams, which with conventional-type inlet-mouths are not capable of catching hold of the oscillating or whirling yarn end quickly. With the novel shape of the inlet mouth, the catching and holding of the yarn end can be achieved in a much better way.

Preferably, the recess at the mouth of the inlet consists of a gradation of the inlet mouth, situated opposite the yarn. Even for the insertion of the yarn before it has been severed, the gradation can serve as a stop for the yarn, and, thus, as an inserting aid. After severing of the yarn, the gradation forms an inserting aid in as much as the whirling or oscillating movement of the yarn end is tranquillized by its striking on the gradation, so that the yarn end can be caught more easily and efficiently.

According to a further configuration of the invention, it is proposed that the recess or a further recess consists of a slit in the mouth of the inlet, running in the direction of the yarn and pointing to the end of the yarn. Such a slit is an additional means for transquillizing the yarn. Moreover, it creates a forced air flow directed away from the yarn end through the slit into the pneumatic holding device, which makes for improved catching and holding of the yarn end.

The invention allows, also the reduction of the time for preparing the yarn ends for splicing, without carrying with it other disadvantages.

An example of a possible configuration of the invention is illustrated in the drawings. By reference to this example, the invention is hereinafter described and explained in more detail.

FIG. 1 shows the front elevation of a pneumatic yarn splicing device.

FIG. 2 shows a sectional view of the pneumatic yarn splicing device, illustrated in FIG. 1, along the line II/II.

FIG. 3 shows a top view of the pneumatic holding device of the pneumatic yarn splicing device according to FIG. 1.

FIG. 4 shows a sectional view of the pneumatic holding device illustrated in FIG. 3, along the line IV/IV.

FIG. 5 shows a sectional view of the pneumatic holding device illustrated in FIG. 3, along the line V/V.

The whole pneumatic yarn splicing device, of which only the parts relating and essential to the invention are shown, is marked with 1. It possesses a body 2 on which is fastened, with a fixing screw 3, a plate 4 and a splicer head 5. A bore 6 of the body 2 is connected through an opening 7 in the plate 4 with a bore 8 of the splicer head 5. From the bore 8 two inlets 9 and 10 for the injection of compressed air lead to a splicing channel 11, which can be closed with the lid 12. Two additional bores 13/14 in the body 2 are for receiving the two pneumatic holding devices 15, 16. The pneumatic holding device 15 consists of an injector tube 17 and a suction tube 19, the pneumatic holding device 16 consists of an injector tube 18 and a suction tube 20. The suction tubes 19 and 20 are fastened to the plate 4. The injector tubes 17 and 18 are mounted in the widened parts 21 or 22 respectively of the bores 13 or 14 respectively, and are held in place and made tight by means of rubber-elastic O-rings (specially shaped gasket rings) 13' or 14' respectively.

FIG. 1 shows that, at the top end of the splicing channel 11, a cover plate 25 is arranged which covers the channel partly, and that a similar cover plate 26 is arranged at the bottom end of the splicing channel 11. the body 2 carries at its top a yarn guide plate 27 and at its bottom a yarn guide plate 28. Above the yarn guide plate 27 there is a yarn severing device 29, below the yarn guide plate 28 a yarn severing device 30. Above the yarn severing device 29 is a further yarn guide plate 31 and below the yarn severing device 30 is a further yarn guide plate 32.

The two suction tubes 19 and 20 have a similar form, the only difference being their position on the plate 4. Their special form is explained hereinafter by reference to FIGS. 3, 4 and 5 taking the suction tube 19 as an example.

The funnel-shaped inlet-mouth 33 of the suction tube 19 belonging to the pneumatic holding device 15 is provided with inserting aids which are shaped as recesses of varying depth and of limited extent. These inserting aids have the purpose of facilitating the insertion and the subsequent seizing by suction of the yarn end 34' of the yarn 34. The one recess consists of a gradation 36 situated opposite the yarn, in the inlet-mouth 33. A further recess consists of a slit 37 in the inlet-mouth 33, running in the direction of the yarn 34 and pointing to the end of yarn 34'. The slit 37 extends from the gradation 36 downwards.

Starting from the gradation 36 as datum level, the slit 37 should be designated as a recess, the remaining part of the inlet-mouth 3 as an elevation.

From FIG. 1 can be seen the position of the yarns 34 and 35 after their insertion into the splicing channel 11, but before they have been severed and the yarn ends 34' or 35' respectively have been produced. The yarn 34 coming from the lower right changes its direction at the cover plate 26, passes over the suction tube 19 and is guided through the opened yarn severing device 29 to the upper right. The yarn 35 coming from the upper left changes its direction at the cover plate 25, passes over the splicing channel 11 and is guided through the opened yarn severing device 30 to the lower left. It can also be seen from FIG. 1 that the two sucking tubes 19 and 20 are mounted in the plate 4 in such a way that their slit-shaped recesses run in the direction of the yarns and point to the subsequent ends of these yarns. The yarn ends are produced by the operation of the two yarn severing devices 29 and 30. Simultaneously with the severing of the yarns compressed air is injected into the wider parts 21 and 22 of the bores 13 and 14. This compressed air flows through the injector bores 38 or 39 respectively into the interior of the injector tubes 17 or 18 respectively, where it creates an air flow streaming in the direction of the arrows 40 or 41 respectively.

The air flow seizes the yarn ends 34' or 35' respectively produced after the action of the yarn severing devices 29, 30, by suction and the measures intrinsic to the invention ensure that this seizing by suction and holding of the yarn is carried out effectively and successfully.

For splicing, the lid 12 is closed and compressed air injected into the bore 6. Before this happens, the two yarns 34 and 35 can, by means of special devices not illustrated here, be drawn back so much that the yarn ends 34' and 35' come almost completely within the splicing channel 11.

The invention is not limited to the example of a possible configuration depicted and described herewith.

I claim:

1. Pneumatic yarn splicing device for the production of a knotfree yarn joint by means of splicing, comprising a splicer head having at least one inlet formed therein for the injection of compressed air, said splicer head receiving the yarn ends to be spliced together and allowing the entanglement, interlocking, intermingling and/or intertwining of their fibres with one another, pneumatic holding devices arranged on either side of said splicing head, each respective pneumatic holding device having an inlet mouth and a tubular inlet for holding the respective yarn ends of the yarn to be spliced together during the yarn preparing process, the inlet mouths of the pneumatic holding device being provided with inserting aids for the yarn ends in the form of recesses of varying depth.

2. Pneumatic yarn splicing device as described in claim 1, wherein the recesses are in the form of a gradation of the mouth of the inlet, situated opposite the yarn.

3. Pneumatic yarn splicing device as described in claim 1, wherein the recesses are in the form of a slit in the mouth of the inlet, running in the direction of the yarn and pointing to the end of the yarn.

4. Pneumatic yarn splicing device for the production of a knotfree yarn joint by means of splicing, comprising a splicer head having at least one inlet formed therein for the injection of compressed air, said splicer head receiving the yarn ends to be spliced together and allowing the entanglement, interlocking, intermingling and/or intertwining of their fibres with one another, pneumatic holding devices arranged on either side of said splicing head, each respective pneumatic holding device having an inlet mouth and a tubular inlet for holding the respective yarn ends of the yarn to be spliced together during the yarn preparing process, the inlet mouths of the pneumatic holding device being provided with inserting aids for the yarn ends in the form of elevations of limited extent.

5. Pneumatic yarn splicing device for the production of a knotfree yarn joint by means of splicing, comprising a splicer head having at least one inlet formed therein for the injection of compressed air, said splicer head receiving the yarn ends to be spliced together and allowing the entanglement, interlocking, intermingling and/or intertwining of their fibres with one another, pneumatic holding devices arranged on either side of said splicing head, each respective pneumatic holding device having an inlet mouth and a tubular inlet for holding the respective yarn ends of the yarn to be spliced together during the yarn preparing process, the inlet mouths of the pneumatic holding device being provided with inserting aids for the yarn ends in the form of recesses of varying depth and elevations of limited extent.

* * * * *